US006128934A

United States Patent [19]

Houghton

[11] Patent Number: 6,128,934

[45] Date of Patent: Oct. 10, 2000

[54] STRETCH REDUCTION MILL

[75] Inventor: David W. Houghton, Longview, Tex.

[73] Assignee: Lone Star Technologies, Inc., Dallas, Tex.

[21] Appl. No.: 09/334,348

[22] Filed: Jun. 16, 1999

Related U.S. Application Data

[60] Provisional application No. 60/131,903, Apr. 30, 1999.

[51] Int. Cl.[7] ..... B21B 37/58

[52] U.S. Cl. ..... 72/10.3; 72/29.1; 72/234; 72/249; 700/151

[58] Field of Search ..... 72/10.1, 10.3, 72/12.1, 13.4, 13.6, 13.7, 14.1, 28.2, 29.1, 234, 249; 700/151

[56] References Cited

U.S. PATENT DOCUMENTS

| | | | |
|---|---|---|---|
| 2,959,992 | 11/1960 | Mitchell . | |
| 3,312,091 | 4/1967 | Kobayashi . | |
| 3,314,264 | 4/1967 | Vater et al. . | |
| 3,766,767 | 10/1973 | Rastelli . | |
| 3,811,304 | 5/1974 | Gorker . | |
| 4,079,608 | 3/1978 | Properzi . | |
| 4,942,543 | 7/1990 | Da Rio et al. . | |
| 5,235,834 | 8/1993 | Bolkey et al. | 72/234 |
| 5,479,803 | 1/1996 | Imanari | 72/234 |
| 5,619,880 | 4/1997 | Polster et al. | 72/11.4 |

FOREIGN PATENT DOCUMENTS

| | | | |
|---|---|---|---|
| 62-289306 | 12/1987 | Japan | 72/10.3 |
| 1186306 | 10/1985 | U.S.S.R. | 72/29.1 |

*Primary Examiner*—Ed Tolan

[57] ABSTRACT

A method and apparatus that provides a multiple-stand stretch reduction mill. A single master controller monitors and controls the roll speed at each roll stand in the mill, automatically and simultaneously maintaining each stand's roll speed at a pre-determined, calculated roll speed.

22 Claims, 3 Drawing Sheets

Computer Program Hierarchy and
Signal / Data Flow
(Normal Operating Mode)

STRETCH REDUCTION MILL

This application claims the benefits of the earlier filed U.S. Provisional Patent App. Ser. No. 60/131,903, filed Apr. 30, 1999 (30.04.1999), which is incorporated by reference for all purposes into this application.

BACKGROUND OF THE INVENTION

1. Field of the Invention

The present invention relates to pipe manufacturing processes. In particular, the present invention provides a method and apparatus for sizing newly formed steel pipe in a stretch reduction mill manufacturing process.

2. Description of the Related Art

Steel pipe is commonly manufactured by various multi-step techniques, all of which include starting with an input product, which may be a welded tube or bar or rod stock, and sizing that product using one or more sizing techniques to create the final desired pipe size and configuration. One sizing technique is to feed input tubes through a hot stretch reduction mill, which produces tubing that may be at its final desired size, or may become input stock for further sizing processes, depending upon the intended final product and application.

In a hot stretch reducing mill, heated tube stock is fed through one or more matched sets of roll stands. Each stand has three contoured rolls that rotate at a predetermined, stand-specific speed. Changes in roll contour determine the overall diameter reduction, while changes in stand roll speed determine final tube wall thickness. Typically, as a heated input tube progresses through the stands, each stand progressively reduces the tube until it reaches the specified exit diameter and wall thickness at the end of the stands. At each stand, the roll speed (revolutions per minute) is progressively increased, causing the heated tube to elongate and increase its linear speed. Note, however, that roll speed may also be decreased, causing an increase in tube thickness.

The hot stretch reduction mill process is typically a smooth, uninterrupted process that consists of first heating the input tube, feeding the heated tube through the stands that stretch and reduce the tube, and then cutting the output tube to length by a flying cut-off saw.

In current hot stretch reduction mills, the drive system for the rolls in each roll stand is typically a hydraulically-driven drive motor, coupled to a hydraulically-driven speed control motor that uses a swash plate speed control device. This arrangement has a number of drawbacks, including imprecise speed control capability (which is exacerbated by wear in the hydraulic units), increasingly frequent maintenance as the drive system ages, and generally high operation and maintenance costs. Perhaps most importantly, the hydraulic speed control motors' feedback time delay is typically too large to maintain effectively the stand's pre-set roll speed. Consequently, setting the speed control motors to produce pipe of the correct dimensions is a process of trial and error—running pipe through the mill, measuring the final product, and adjusting the motors—that results in wasted pipe that must be re-melted and processed.

The present invention overcomes these drawbacks by replacing the hydraulic speed control motor and swash plate speed control device in each stand's drive system with an electronic stand controller and an electric motor in a feedback loop. Each stand controller couples to a master controller. Speed pickup devices at each stand continuously monitor final stand rotation speed and send that information to the master controller. The master controller compares those measured values with the desired stand speed at each stand, and provides signals to the individual stand controllers that adjust the stand motor speed as required to maintain the desired stand speed. The master controller that controls the entire system interfaces with the operator through a standard desktop computer workstation. The present invention is thus a method and apparatus that precisely and continuously controls the roll speed of a plurality of roll stands in tube reducing mills. The present invention improves product quality by reducing product size variation and reduces operations costs associated with repairing hydraulic fluid leaks and reduces other maintenance costs.

SUMMARY OF THE INVENTION

The present invention is a system that automatically monitors and controls the roll speed of each roll stand in a multiple-stand tube reducing mill. A master controller is coupled to each individual roll stand and to a computer. The computer calculates—based on data input by the user—a desired roll speed for each said roll stand and transmits to the master controller a signal corresponding to this calculated desired roll speed. The master controller then sends to each individual stand controller a reference signal that corresponds to the calculated desired roll speed.

Each roll stand has its own stand controller that controls an associated speed control motor for that roll stand. An encoder measures actual speed control motor speed; the stand controller compares that measured speed to the reference signal and maintains the speed control motor at the proper speed.

Each roll stand has a speed pickup that measures actual roll stand speed and transmits a signal corresponding to this measured roll speed to the master controller. The master controller then compares the measured roll speed for each roll stand with the desired roll speed for each roll stand and adjusts its reference signal such that said measured roll speed matches the desired roll speed.

BRIEF DESCRIPTION OF THE DRAWINGS

To further aid in understanding the invention, the attached drawings help illustrate specific features of the invention and the following is a brief description of the attached drawings.

DETAILED DESCRIPTION OF THE INVENTION

The present invention comprises a multiple roll stand stretch reduction mill having a master controller that simultaneously and automatically monitors and controls the stand speed at a plurality of roll stands. This disclosure describes numerous specific details that include specific structures, control devices, and feedback systems in order to provide a thorough understanding of the present invention. One skilled in the art will appreciate that one may practice the present invention without these specific details.

The present invention is a method and apparatus for controlling the roll speed of a plurality of roll stands in tube reducing mills. Specifically, a computer determines the appropriate number of stands and the appropriate roll speed at each stand, based upon the input product size (tube diameter and wall thickness), the desired output product size, and the desired exit speed. The computer then provides stand speed information to a master controller, which controls one or more separate stand controllers. The separate stand controllers adjust the roll speed of their respective stands by controlling an electric speed control motor at each stand.

Figure 1:
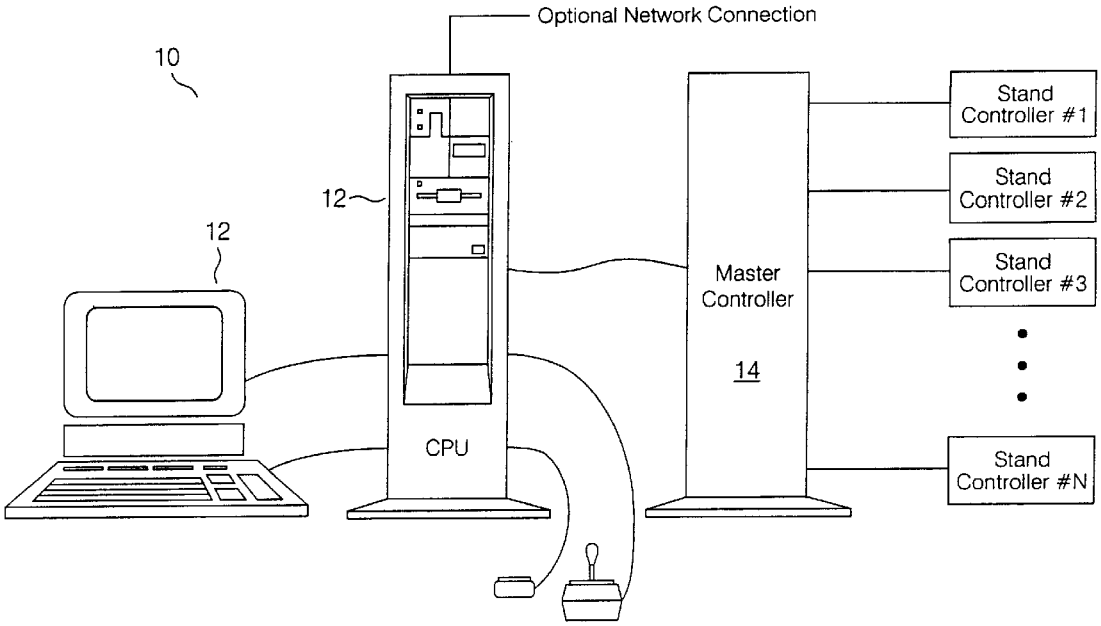
FIG. 1 is a schematic showing the interconnection of the master controller to the stand controllers, CPU, and data input device.
Figure 2A:
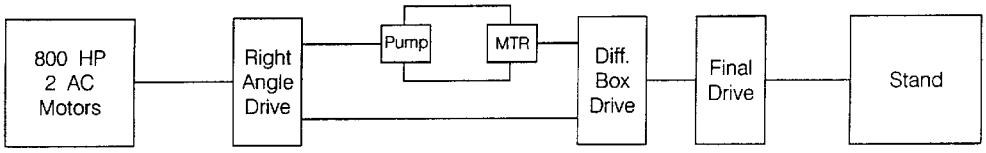
PRIOR ART FIG. 2A
FIG. 2A is a block diagram illustrating a typical existing hydraulically-driven stand drive configuration.
Figure 2B:
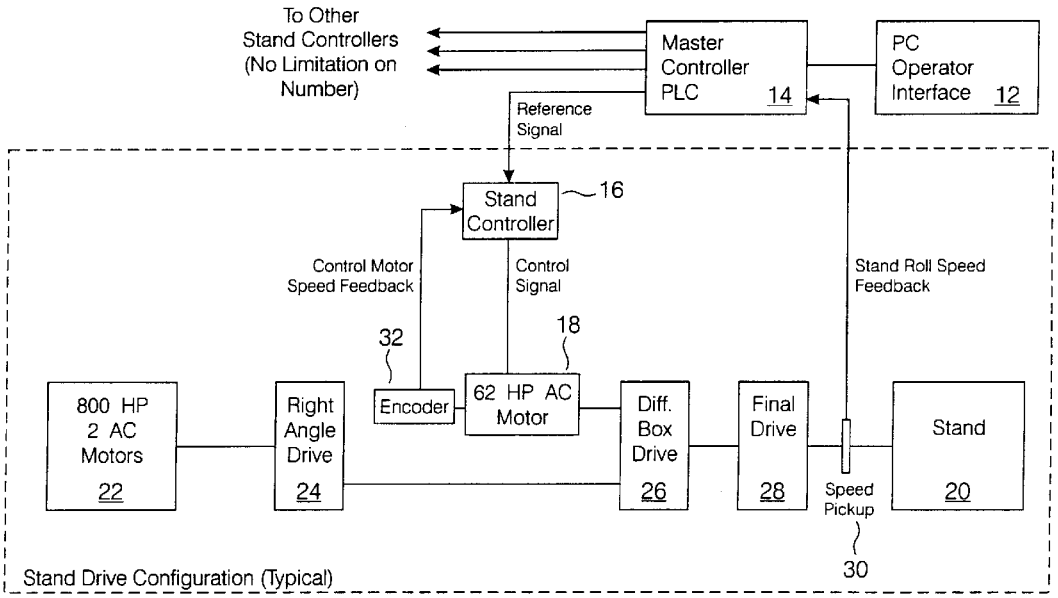
FIG. 2B is a block diagram of an embodiment of the present invention.

FIGS. 1 and 2B illustrate the interrelation of some of the major components of the present invention 10. In automatic mode, the operator inputs tube parameters into computer 12, typically a standard desktop personal computer. The tube parameters include: initial tube diameter and thickness and desired final tube diameter, thickness, and linear speed. Computer 12 calculates the number of roll stands, and the speed of each roll stand, required to produce tube of the desired dimensions from the initial rough stock. Computer 12 then transmits this information to master controller 14. Based on the computed roll stand speed calculations, master controller 14 transmits to each stand controller 16 a reference signal that corresponds to a desired roll stand speed.

The master controller, which in a preferred embodiment is a standard programmable logic controller ("PLC") such as a Modicon brand Quantum series PLC, interfaces with a standard desktop computer with a keyboard and monitor, and with a number of individual stand speed controllers. In the preferred embodiment, the individual stand speed controllers are Siemens Variable Speed Drives. The operator provides input product entry wall thickness, desired exit wall thickness, exit diameter, and exit speed. Based upon these inputs, the computer calculates the number of roll stands required for the product run for a given input product tube diameter. The computer also calculates the roll speed required at each stand, and sends that information to the master controller.

FIG. 2A shows a typical existing hydraulically-driven stand drive configuration, and, in comparison, FIG. 2B illustrates the preferred embodiment of present invention. Note the hydraulic motor and pump between the right angle drive and the differential box drive have been replaced by the stand controller, electric speed control motor, and encoder. Additionally, as shown in FIG. 2B, speed pickup devices have been inserted between the final drive and the stand. In normal or automatic mode operation, the master controller sends a reference signal that corresponds to a desired roll speed to each individual stand controller. As the pipe is fed through each stand, the speed pickup devices continuously measure the stand speed, and provide that information back to the master controller. The master controller then compares the measured speed at each stand with the desired speed at that stand, and adjusts the reference signal to the individual stand controller. That signal adjustment causes the stand controller to speed up, slow down, or maintain the speed of the electric speed control motor as required to make the actual stand speed equal the desired stand speed. The master controller is capable of simultaneously controlling and providing adjustment to any number of individual stand controllers, thus controlling the entire stretch reduction mill process from start to finish.

As shown in FIG. 2B, each speed control motor has an encoder that measures the actual speed of the speed control motor and sends that information to the stand controller. The stand controller then compares the measured speed feedback with the reference signal provided by the master controller and adjusts speed control motor speed to maintain desired roll stand speed.

Each stand controller 16 controls a speed control motor 18. The speed control motors 18 "fine-tune" the speed of the roll stands 20 by engaging differential box drive 26 and adding to or subtracting from the rotational speed generated by two 800 horsepower AC motors 22, which drive the roll stands. Motors 22 engage a right angle drive 24 whose output engages differential box drive 26, where the output of speed control motor 26 adjusts the final output speed. The output of differential box drive 26 engages final drive 28, which in turn drives roll stand 20.

Speed pickup 30, located between final drive 28 and roll stand 20, measures the rotational speed of roll stand 20, generates a feedback signal corresponding to the measured roll speed, and transmits this feedback to master controller 14. The master controller then compares this measured roll speed with the computer-calculated desired roll speed and adjusts the reference signal accordingly.

Similarly, encoder 32 measures the actual speed of speed control motor 18 and transmits a corresponding feedback signal to stand controller 16, which then compares the actual speed feedback from encoder 32 with the reference signal from master controller 14 and adjusts its control signal to maintain speed control motor 18 at a speed sufficient to maintain roll stand 20 at its proper speed.

In manual mode, the operator selects and directly inputs into the computer 12 a speed control motor speed. The master controller 14 then sends to the stand controller 16 a reference signal based on this operator-selected speed control motor speed. In manual operation, the stand roll speed feedback loop is disabled. The control motor feedback loop operates as in automatic.

The present invention is also capable of functioning in manual mode. In manual mode, the operator determines and sends (via the computer interface) a speed control motor speed reference to each individual stand controller. The individual stand controller then commands the speed control motor to the set speed. Each speed control motor includes an encoder, which is a device that measures motor speed. The encoder provides actual motor speed to the individual stand controller, which then compares actual motor speed with the set speed and adjusts the motor speed to achieve and maintain the set speed.

Figure 3:
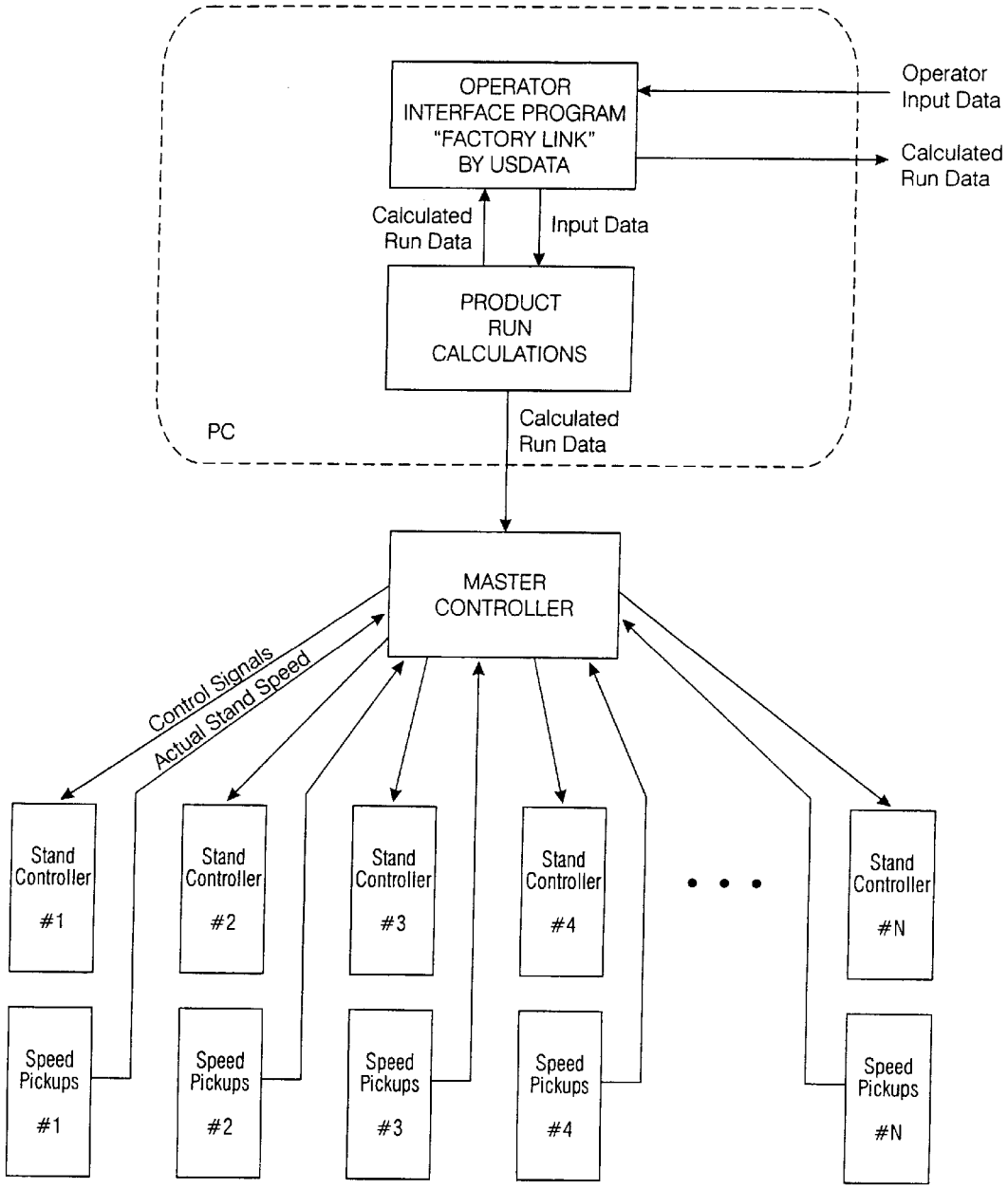
FIG. 3 is a block diagram showing the interconnection and data flow of the various control components of the system.

FIG. 3 shows the interconnection and data flow of the various control components of the system. As described above, the operator interfaces to the system via a standard computer keyboard, using an off-the-shelf operator interface program. In the preferred embodiment, the interface program is "Factorylink" by USData. The operator inputs the product run data as described above, and the computer calculates the number of stands and appropriate stand speeds to achieve the desired product size and exit speed. That information is provided to the master controller, which then provides control signals to the stand controllers and receives actual speed data from the speed pickups at each stand.

Other embodiments of the invention will be apparent to those skilled in the art after considering this specification or practicing the disclosed invention. The specification and examples above are exemplary only, with the true scope of the invention being indicated by the following claims.

I claim the following invention:

1. A system that monitors and controls the roll speed of each roll stand in a plurality of roll stands in a tube reducing mill, comprising:

a plurality of roll stands;

at least one AC electric motor for driving said roll stands;

a plurality of drives, one of each said plurality of drives coupling said at least one AC motor to one of each said roll stands;

a master controller, said master controller coupled to each individual roll stand of said plurality of roll stands, that monitors and controls the roll speed of said individual roll stands of said purality of roll stands;

a computer that calculates a desired roll speed for each said roll stand of said plurality of roll stands and transmits to said master controller a signal corresponding to said desired roll speed;

a plurality of speed control motors, each speed control motor of said plurality of speed control motors coupled to a single drive and coupled to said master controller;

a plurality of speed pickups, one of each speed pickup of said plurality of said speed pickups coupled to a single roll stand, wherein said speed pickups measure the roll speed of each roll stand and transmit a signal corresponding to said measured roll speed to said master controller; and a plurality of stand controllers, each stand controller of said plurality of stand controllers coupled to said speed control motor and said master controller, each said stand controller receives a reference signal from said master controller, said reference signal corresponds to a desired motor speed.

2. The system of claim 1 wherein said master controller:

sends to each speed control motor a reference signal that corresponds to a desired roll speed;

compares said measured roll speed for each roll Stand with a desired roll speed for each roll stand; and adjusts said reference signal such that said measured roll speed matches said desired roll speed.

3. The system of claim 1 further comprising:

an encoder coupled to each said speed control motor that measures the speed of its associated speed control motor and transmits a signal corresponding to said measured motor speed to said stand controller.

4. The system of claim 3 wherein said stand controller compares said measured speed control motor speed signal with said reference signal and adjusts said speed control motor speed to maintain said speed control motor speed at a speed corresponding to said reference signal.

5. The system of claim 1 wherein said plurality of speed control motors are AC electric motors.

6. An apparatus that monitors and controls the roll speed of each roll stand in a plurality of roll stands in a tube reducing mill, comprising:

a plurality of roll stands;

at least one motor for driving said roll stands;

a plurality of drives, one of each said plurality of drives coupling said at least one motor to one of each said roll stands;

a master controller, said master controller coupled to each individual roll stand of said plurality of roll stands, that monitors and controls the roll speed of said individual roll stands of said plurality of roll stands;

a computer that calculates a desired roll speed for each said roll stand of said plurality of roll stands and transmits to said master controller a signal corresponding to said desired roll speed;

a plurality of speed control motors, each speed control motor of said plurality of speed control motors coupled to a single drive and coupled to said master controller;

a plurality of speed pickups, one of each speed pickup of said plurality of said speed pickups coupled to a single roll stand, wherein said speed pickups measure the roll speed of each roll stand and transmit a signal corresponding to said measured roll speed to said master controller; and a plurality of stand controllers, each stand controller of said plurality of stand controllers coupled to said speed control motor and said master controller, each said stand controller receives a reference signal from said master controller, said reference signal corresponds to a desired motor speed.

7. The apparatus of claim 6 wherein said master controller:

sends to each speed control motor a reference signal that corresponds to a desired roll speed;

compares said measured roll speed for each roll stand with a desired roll speed for each roll stand; and adjusts said reference signal such that said measured roll speed matches said desired roll speed.

8. The apparatus of claim 6 further comprising:

an encoder coupled to each said speed control motor that measures the speed of its associated speed control motor and transmits a signal corresponding to said measured motor speed to said stand controller.

9. The apparatus of claim 8 wherein said stand controller compares said measured speed control motor speed signal with said reference signal and adjusts said speed control motor speed to maintain said speed control motor speed at a speed corresponding to said reference signal.

10. The apparatus of claim 6 wherein said plurality of speed control motors are AC electric motors.

11. A method that provides a system that monitors and controls the roll speed of each roll stand in a plurality of roll stands in a tube reducing mill, comprising:

providing a plurality of roll stands;

providing at least one AC electric motor for driving said roll stands; providing a plurality of drives, each said drive coupling said at least one AC motor to one of each said roll stands;

coupling a master controller to each individual roll stand of said plurality of roll stands, wherein said master controller monitors and controls the roll speed of said individual roll stands of said plurality of roll stands;

providing a computer that calculates a desired roll speed for each said roll stand of said plurality of roll stands and transmits to said master controller a signal corresponding to said desired roll speed;

providing a plurality of speed control motors;

coupling each speed control motor of said plurality of speed control motors to a single individual drive;

coupling one of each speed control motor of said plurality of speed control motors to said master controller;

providing a plurality of speed pickups;

coupling each speed pickup of said plurality of said speed pickups to a single individual roll stand, wherein said speed pickups measure the roll speed of each roll stand and transmit a signal corresponding to said measured roll speed to said master controller; and providing a plurality of stand controllers, wherein each said stand controller of said plurality of stand controllers is coupled to said speed control motor and to said master controller, wherein each said stand controller receives from said master controller a reference signal that corresponds to a desired motor speed.

12. The method of claim 11 wherein said master controller:

sends to each speed control motor a reference signal that corresponds to a desired roll speed;

compares said measured roll speed for each roll stand with a desired roll speed for each roll stand; and adjusts said reference signal such that said measured roll speed matches said desired roll speed.

13. The method of claim 11 further comprising:

providing an encoder, coupled to each said speed control motor, that measures the speed of its associated speed control motor and transmits a signal corresponding to said measured motor speed to said stand controller.

14. The method of claim 13 wherein said master controller compares said measured speed control motor speed signal with said reference signal and adjusts said speed control motor speed to maintain said speed control motor speed at a speed corresponding to said reference signal.

15. A method that uses a master controller that monitors and controls the roll speed of each roll stand in a plurality of roll stands in a tube reducing mill, comprising:

providing a plurality of roll stands;

providing at least one AC electric motor for driving said roll stands;

providing a plurality of drives, each said drive coupling said at least one AC motor to one of each said roll stands;

monitoring and controlling the roll speed of each individual roll stand of said plurality of roll stands with a master controller, said master controller coupled to each said individual roll stand of said plurality of roll stands;

calculating a desired roll speed for each said roll stand of said plurality of roll stands;

transmitting to said master controller a signal corresponding to said desired roll speed;

providing a plurality of speed control motors;

coupling each speed control motor of said plurality of speed control motors to a single individual drive;

coupling each speed control motor of said plurality of speed control motors to said master controller;

providing a plurality of speed pickups;

coupling each speed pickup of said plurality of said speed pickups to a single individual roll stand, wherein said speed pickups measure the roll speed of each roll stand and transmit a signal corresponding to said measured roll speed to said master controller;

providing a plurality of stand controllers; and coupling each stand controller of said plurality of stand controllers to said speed control motor in a closed loop feedback manner and to said master controller, wherein each said stand controller receives from said master controller a reference signal that corresponds to a desired motor speed.

16. The method of claim 15 wherein said master controller:

sends to each speed control motor a reference signal that corresponds to a desired roll speed;

compares said measured roll speed for each roll stand with a desired roll speed for each roll stand; and adjusts said reference signal such that said measured roll speed matches said desired roll speed.

17. The method of claim 15 further comprising:

coupling to each said speed control motor an encoder in said closed loop that measures the speed of its associated speed control motor and transmits a signal corresponding to said measured motor speed to said stand controller.

18. The method of claim 17 further comprising:

comparing said measured speed control motor speed signal with said reference signal; and adjusting said speed control motor speed to maintain said speed control motor speed at a speed corresponding to said reference signal.

19. A programmable storage device, readable by a machine, tangibly embodying a program of instructions executable by the machine to perform a method that uses a master controller to monitor and control the roll speed of each roll stand in a plurality of roll stands in a tube reducing mill, comprising:

providing a plurality of roll stands;

providing at least one AC electric motor for driving said roll stands;

providing a plurality of drives, each said drive coupling said at least one AC motor to one of each said roll stands;

monitoring and controlling the roll speed of each individual roll stand of said plurality of roll stands with a master controller, said master controller coupled to each said individual roll stand of said plurality of roll stands;

calculating a desired roll speed for each said roll stand of said plurality of roll stands;

transmitting to said master controller a signal corresponding to said desired roll speed;

providing a plurality of speed control motors;

coupling each speed control motor of said plurality of speed control motors to a single individual drive;

coupling each speed control motor of said plurality of speed control motors to said master controller;

providing a plurality of speed pickups;

coupling each speed pickup of said plurality of said speed pickups to a single individual roll stand, wherein said speed pickups measure the roll speed of each roll stand and transmit a signal corresponding to said measured roll speed to said master controller;

providing a plurality of stand controllers; and coupling each stand controller of said plurality of stand controllers to said speed control motor and to said master controller, wherein each said stand controller receives from said master controller a reference signal that corresponds to a desired motor speed.

20. The programmable storage device of claim 19 wherein said master controller:

sends to each speed control motor a reference signal that corresponds to a desired roll speed;

compares said measured roll speed for each roll stand with a desired roll speed for each roll stand; and adjusts said reference signal such that said measured roll speed matches said desired roll speed.

21. The programmable storage device of claim 19 further comprising:

coupling to each said speed control motor an encoder that measures the speed of its associated speed control motor and transmits a signal corresponding to said measured motor speed to said stand controller.

22. The programmable storage device of claim 21 further comprising:

comparing said measured speed control motor speed signal with said reference signal; and adjusting said speed control motor speed to maintain said speed control motor speed at a speed corresponding to said reference signal.

* * * * *